United States Patent [19]

Reda et al.

[11] 4,450,651

[45] May 29, 1984

[54] STATIONARY GRINDING WHEEL DRESSING UNIT

[75] Inventors: Kazimierz J. Reda; Victor F. Dzewaltowski; Lawrence I. Millay; Robert N. Hobbs, all of Springfield, Vt.

[73] Assignee: Ex-Cell-O Corporation, Troy, Mich.

[21] Appl. No.: 262,233

[22] Filed: May 11, 1981

[51] Int. Cl.[3] ..... B24B 5/00

[52] U.S. Cl. ..... 51/5 D; 125/11 CD; 125/11 DF

[58] Field of Search ..... 125/11 R, 11 SF, 11 CD; 51/165.93, 165.91, 165.87, 5 D

[56] References Cited

U.S. PATENT DOCUMENTS

| | | | |
|---|---|---|---|
| 2,513,228 | 6/1950 | Arms | 51/165.93 |
| 2,771,714 | 11/1956 | Schmidt | 51/165.91 |
| 3,209,498 | 10/1965 | Dall | 51/103 TF |
| 3,553,893 | 1/1971 | Stade | 51/5 D |
| 3,714,741 | 2/1973 | Uhtenwoldt | 51/165.91 |
| 3,739,528 | 6/1973 | Robillard | 51/5 D |
| 3,798,840 | 3/1974 | Robillard | 51/165.93 |
| 4,085,554 | 4/1978 | Sugita | 51/165.87 |
| 4,170,851 | 10/1979 | Enos | 51/165.93 |

*Primary Examiner*—Harold D. Whitehead

*Attorney, Agent, or Firm*—Edward J. Timmer

[57] ABSTRACT

An interchangeable and stationary grinding wheel dressing structure mounted on a cantilevered base unit having the grinding wheel carried to it for dressing.

4 Claims, 8 Drawing Figures

10
35
45
15
20
21
23
W
43
47
17
-13-
12
19

STATIONARY GRINDING WHEEL DRESSING UNIT

TECHNICAL FIELD

This invention relates generally to the grinding machine art, and more specifically, to a stationary wheel dressing unit mounted on bridge adjacent the grinding wheel with the grinding wheel traveling to the stationary dresser.

BACKGROUND ART

It is well known in the grinding machine art to dress the outside periphery of the abrasive grinding wheel by several methods or forms; such as, a single point diamond, a multipoint diamond, rotary diamond, or diamond roll. The type of work being performed prescribes the dressing method which will provide optimum performance. Moreover, dressers have been made a stationary unit and also a pivoted swinging arm unit.

DISCLOSURE OF THE INVENTION

The invention relates to a dresser for dressing the outside periphery of a grinding wheel by means of a stationary unit with the grinding wheel adapted to travel to it. The use of a stationary dressing unit provides for stability and accuracy required to obtain optimum performance, which not only provides for a simpler and more reliable method of dressing, but enhances diamond life as well. This is in contrast to prior arrangements which had a movable dresser arm. Such arrangements have built-in spring rates which can cause a poor dress condition. Most single point, cluster and rotary dressers are interchangeable and use the same common base.

BEST MODE FOR CARRYING OUT THE INVENTION

Figure 1:
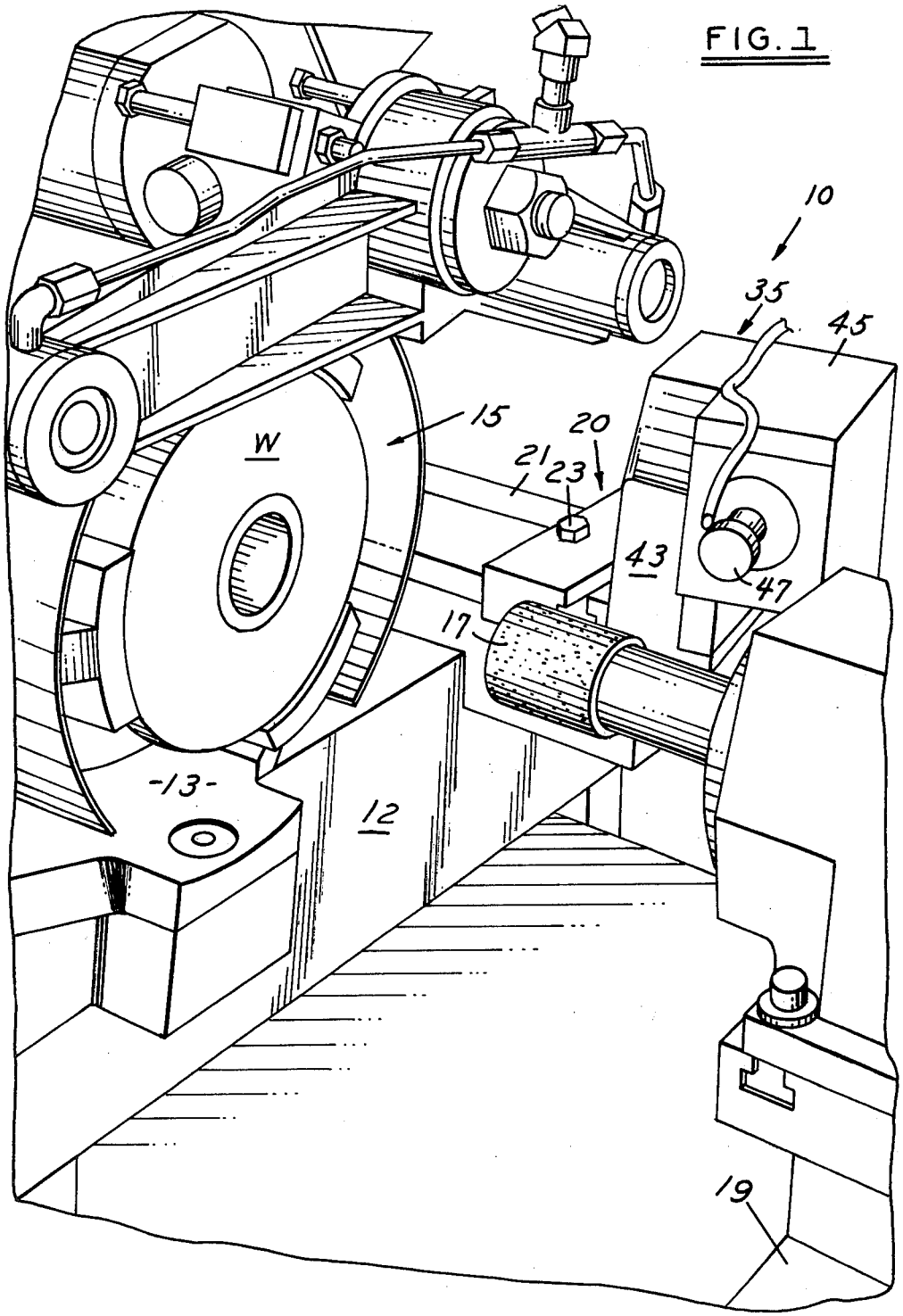
FIG. 1 shows a perspective view disclosing a first illustrative embodiment of the grinding wheel before it approaches the bore of the workpiece and the wheel dressing unit.

Referring now to the drawings, and in particular to FIG. 1, the numeral 10 generally designates a one-station electro-mechanical internal grinding machine with one grinding wheel spindle on a cross slide, and embodying the principles disclosed in copending application Ser. No. 152,286 filed May 22, 1980.

The grinding machine 10 includes a conventional bed or bridge member 12 on which is operatively mounted a conventional workhead 13. The workhead 13 may be of any suitable conventional structure and it comprises a chucking fixture 15 for holding a workpiece. The chucking fixture is adapted to be rotated by a motor and an operatively connected pulley means disclosed in the above-mentioned copending application.

As shown in FIG. 1, a bore grinding wheel 17 is operatively carried on the compound slide assembly 19, on the right end of the machine 10, which comprises the longitudinal and cross slides disclosed in the above-noted copending application. It will be understood that the control system of the present invention is capable of controlling any combination of motions of a grinding wheel on the compound slide assembly.

The grinding wheel dressing unit 20 is mounted on the workhead bridge 12 on a base extension member 21 which extends or cantilevers over the center of the machine grinding area. The dressing unit 20 is secured by means of bolts 23 slidable in T-slots 25 of the base extension member 21, as shown in FIG. 2.

Figure 3:
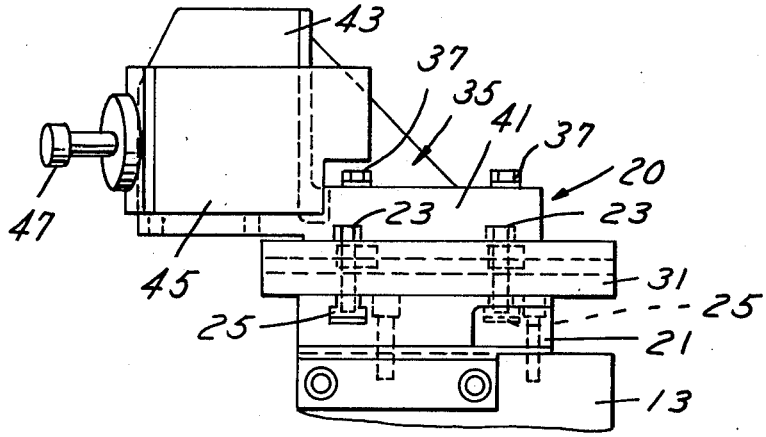
FIG. 3 is a left end view of the dressing cutter unit.
Figure 2:
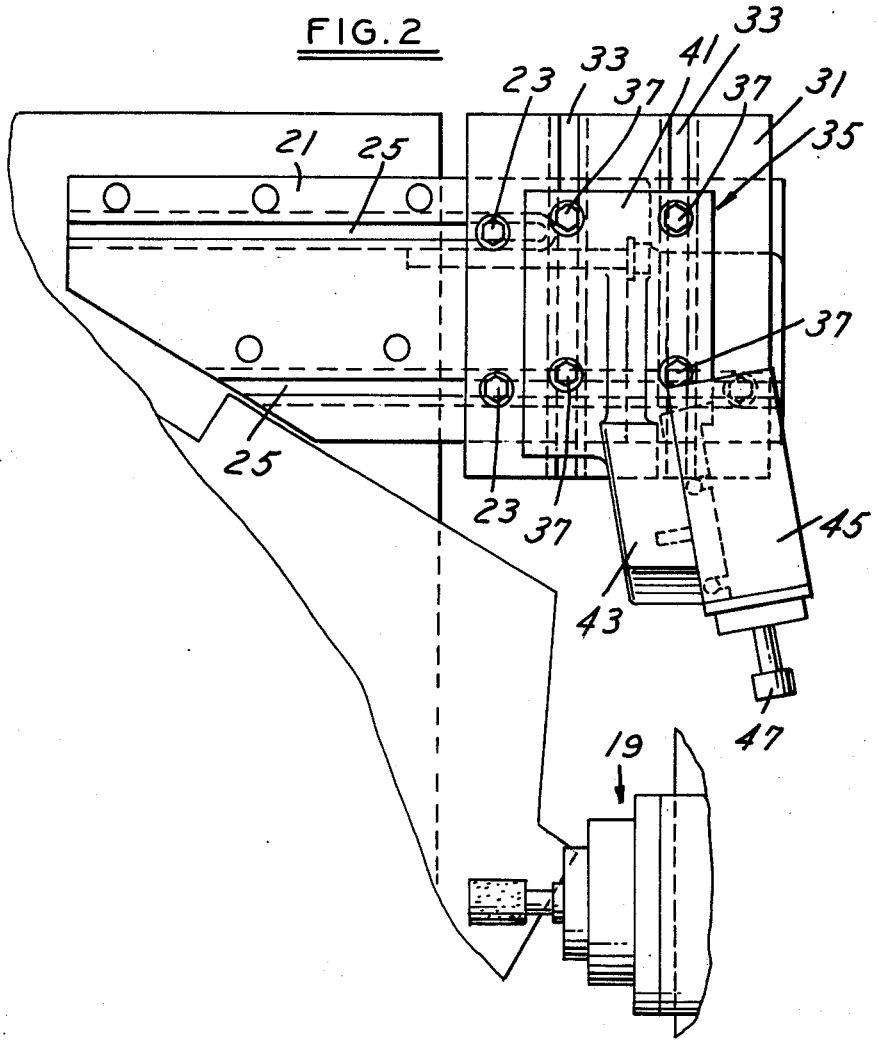
FIG. 2 is a top view of the dressing cutter unit.

FIGS. 2 and 3 illustrate the general structural layout which shows the dressing unit 20 comprising a base 31 adapted to be slidable and secured in a longitudinal direction by means of bolts 23 and having transverse T-slots 25 on the uppermost top portion. Slidably mounted on the base 31 by means of transverse slots 33 is the slide base unit 35 which is secured thereto by means of a plurality of bolts 37. It is illustrated in FIG. 2 that the slide base unit 35 is adapted to be moved and positioned by means of slots 33 and 25 and secured thereto by a plurality of bolts 37 and 23, respectively.

The slide base unit 35 comprises a flat bed portion 41 and a transverse portion 43 extending upwardly to form a side support or wall for the dressing cutter 45. The stationary dressing cutter unit 45 illustrated in FIGS. 1, 2 and 3 comprises a rotatable dressing cutter 47 which dresses the grinding wheel 17 as the grinding wheel 17 moves on its compound slide past the dressing cutter 47.

Figure 4:
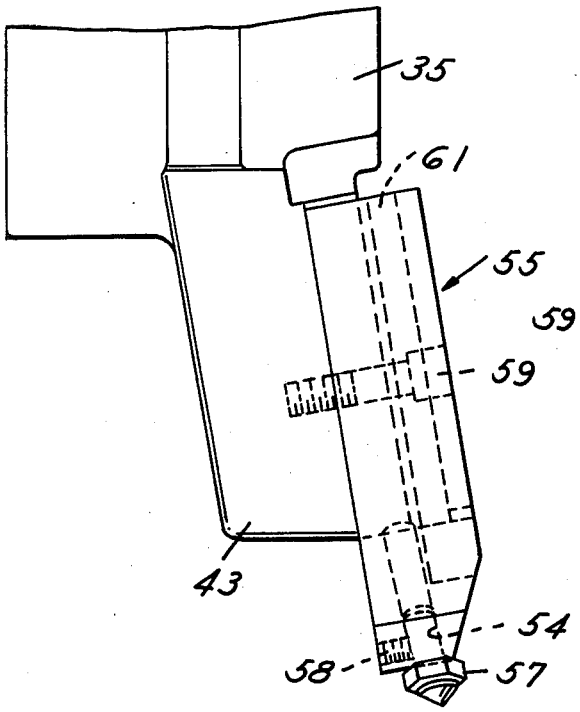
FIG. 4 is another embodiment of the dressing unit showing a top view of a single point diamond dresser.
Figure 5:
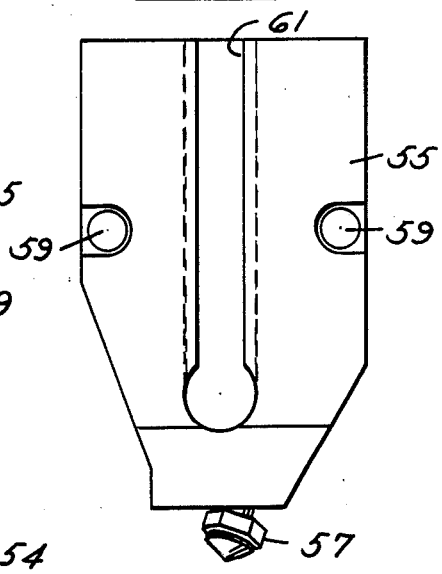
FIG. 5 is a right end view of the wheel dressing cutter unit before mounting to the base as shown in FIG. 4.

FIG. 4 shows another embodiment wherein the dressing cutter unit 55 comprises a single point diamond 57 mounted in bore 54 and attached on the end thereof by means of screw 58. The dressing cutter unit 55 is secured to the transverse portion 43 of the slide base unit 35 by means of bolts 59. As illustrated in FIG. 5, the dressing cutter unit 55 includes a slot 61 for purposes to be disclosed hereinafter.

Figure 6:
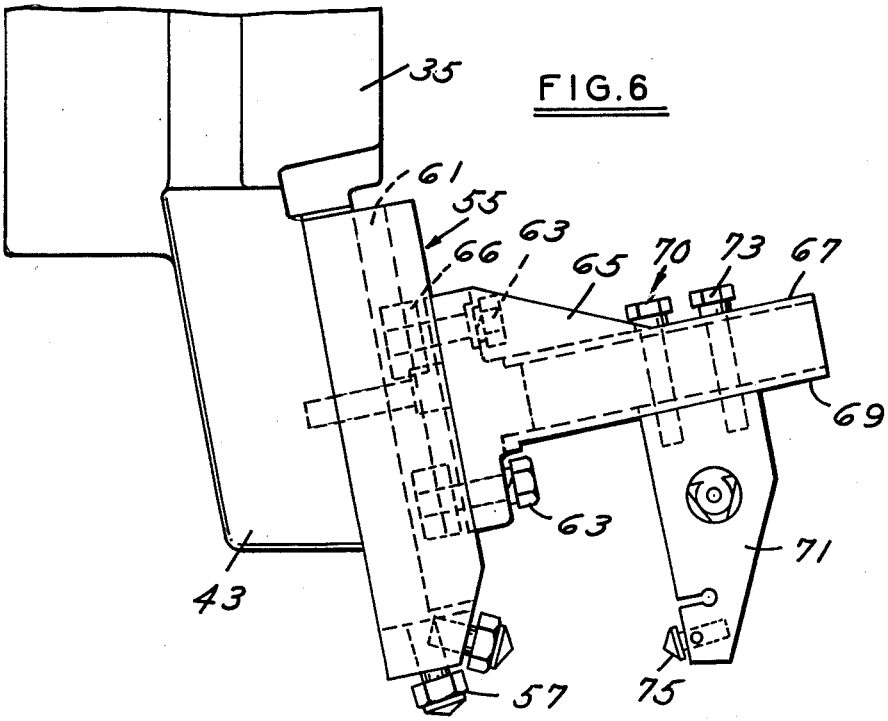
FIG. 6 is a further embodiment of the wheel dressing cutter showing a plurality of single point diamond dressers.

FIG. 6 shows another embodiment comprising a facing cutter 70 mounted to the body of cutter 55 by means of bolts 63 connected to nuts 66 slidably disposed within an undercut track of slot 61. The dressing cutter 70 includes an extension brace 65 having longitudinal slots 67, 69 whereby a facing cutter brace 71 is attached thereto by means of bolts 73. The facing cutter brace 71 includes a single point diamond 75 and is adapted to dress the end of the grinding wheel.

Figure 7:
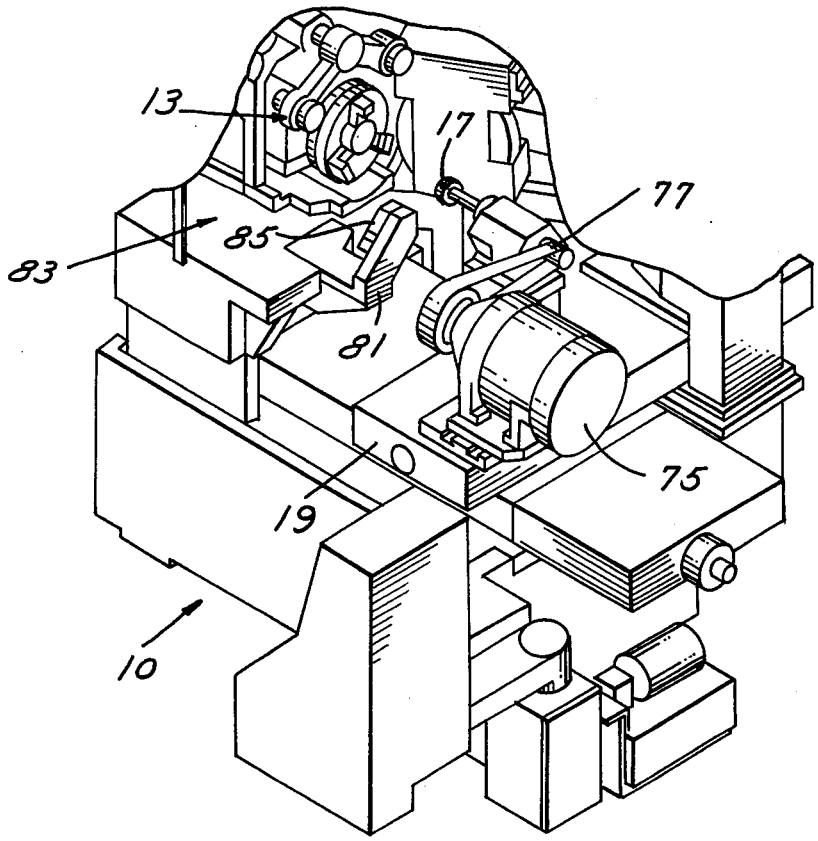
FIG. 7 is a perspective view of another embodiment showing the grinding wheel before it approaches the workpiece and the cantilevered dressing cutter mounted on the front of the machine.
Figure 8:
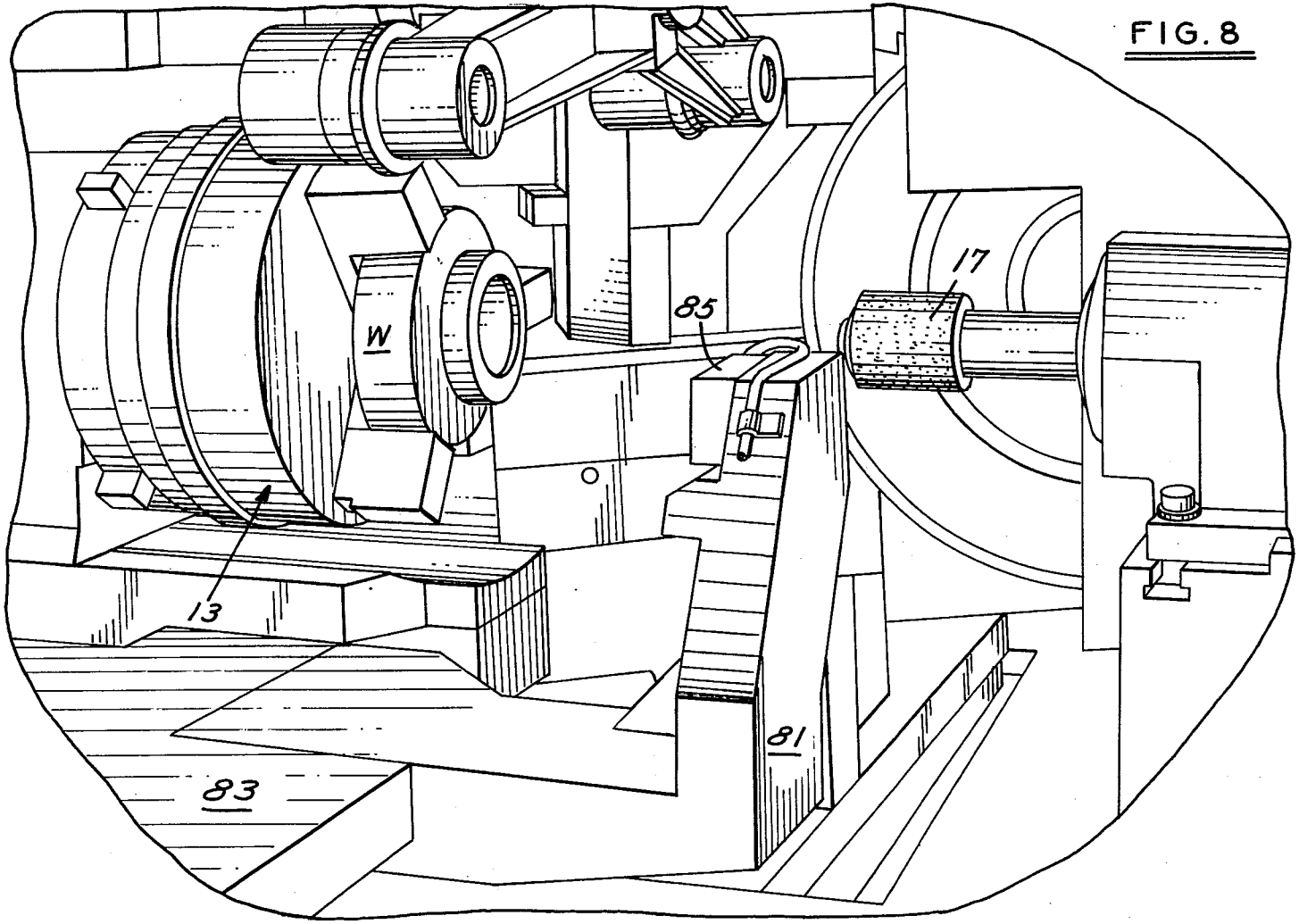
FIG. 8 is a close-up perspective view shown in FIG. 7 illustrating the cantilevered wheel dressing cutter unit.

As illustrated in FIGS. 7 and 8, the grinding wheel 17 is operatively carried on the compound slide assembly 19, on the right end of the machine 10, which comprises the longitudinal and cross slides. The grinding wheel is adapted to be rotated by a motor 75 and operatively connected pulley means 77, in a conventional manner. The wheel dressing cutting unit 81 is mounted in cantilever fashion to the bridge 83 of the workhead at the front end of the machine 10. The dressing cutter 85 is attached to the cantilevered dressing cutter unit 81 in a similar manner heretofor disclosed.

In operation, the grinding wheel 17 is rotated to grind the bore or face or any combination thereof. The longitudinal slide provides the grinding wheel 17 with a sequence of movements such as rapid forward traverse, slow infeed, high speed reciprocation and back-off retraction. The cross slide provides the grinding wheel 17 with positioning movements and compensation movements to compensate for the wearing away of the grinding wheel in the grinding of each part. The control system of the present invention is disclosed in copending aforementioned patent application and need not be discussed in detail herein. However, it is understood that after the programmed grinding operations have been carried out by the grinding wheel 17, it is retracted from the workpiece and dressed for further grinding operations. That is, the grinding wheel 17 is carried on the compound slide over to the wheel dressing unit 81 and dressed by a single point diamond, or a diamond roll, or a rotary diamond, or a diamond cluster such as disclosed herein. The stationary unit of the dresser can be rigidly clamped and formed with relatively stiff plate segments that define a stable accurately positioned platform for the dresser cutter which has a reduced spring rate. The dresser cutter is positioned more accurately to provide for a more accurate and stable method of dressing the grinding wheel which not only is simple and more reliable, but enhances diamond life as well.

As disclosed, most single point, cluster and rotary dresser units are interchangeable and use the same common stable stationary base.

We claim:

1. A grinding machine having a machine bed, a workhead, a longitudinal slide, a cross-slide and a grinding wheel head operatively provided with a grinding wheel for operative engagement with a workpiece carried by said workhead, characterized as further having:

(a) a base extension member mounted on the workhead in cantilever fashion to extend over the machine grinding area and having a first pair of spaced apart undercut slots therein extending in a longitudinal direction relative to the grinding wheel, including means mounting the base extension member in stationary position on the workhead, (b) a first dressing unit base member positionable longitudinally on the base extension member and having a second pair of spaced apart undercut slots therein extending in a transverse direction toward the grinding wheel, including bolt and nut means in said first pair of slots mounting the first dressing unit base member in an adjusted stationary position on the base extension member, (c) a second dressing unit base member positionable transversely on the first dressing unit base member including a stiff base portion and interconnected stiff transverse portion and including bolt and nut means in said second pair of slots mounting the base portion in an adjusted stationary position on the first dressing unit base member, (d) said base extension member, first dressing unit base member and second dressing unit base member providing a stable stationary platform, and (e) a dressing cutter unit mounted on the second dressing unit base member of the stable stationary platform cantilevered over the machine grinding area and to which the grinding wheel is moved for dressing.

2. The invention as defined in claim 1 wherein said wheel dressing unit comprises a single point diamond.

3. The invention as defined in claim 1 wherein said wheel dressing unit comprises a rotary diamond cutter.

4. The invention as defined in claim 1 wherein said wheel dressing unit comprises a plurality of single point diamond dressers adapted to dress bore and face of a grinding wheel.

* * * * *